US005636482A

United States Patent [19]

Klager

[11] Patent Number: 5,636,482

[45] Date of Patent: Jun. 10, 1997

[54] WOOD FENCE POST REPAIR DEVICE AND METHOD

[76] Inventor: James E. Klager, 316 Williamson Pl., Corpus Christi, Tex. 78411

[21] Appl. No.: 526,369

[22] Filed: Sep. 11, 1995

[51] Int. Cl.[6] ..... E04H 17/22; E04H 17/26

[52] U.S. Cl. ..... 52/165; 52/170; 52/169.13; 52/514; 52/698; 52/745.17; 256/DIG. 5

[58] Field of Search ..... 52/165, 170, 155, 52/158, 169.13, 698, 574, 745.17; 256/1, 59, DIG. 5

[56] References Cited

U.S. PATENT DOCUMENTS

| | | | |
|---|---|---|---|
| 47,910 | 5/1865 | Sheilds | 52/165 |
| 205,685 | 7/1878 | Romaine | 52/165 |
| 394,854 | 12/1888 | Helfenberger et al. | 52/165 |
| 405,658 | 6/1889 | Campany | 52/170 |
| 427,815 | 5/1890 | Wolf | 52/165 |
| 525,119 | 8/1894 | Robbins | 52/165 |
| 1,038,147 | 9/1912 | Johnson | 52/165 |
| 4,543,757 | 10/1985 | Cosgrove | 52/165 X |
| 4,598,512 | 7/1986 | Chapman | 52/165 |
| 4,615,156 | 10/1986 | Deike | 52/165 X |
| 4,646,489 | 3/1987 | Feller et al. | 52/165 |
| 4,951,904 | 8/1990 | Obenshain | 52/165 X |

FOREIGN PATENT DOCUMENTS

| | | | |
|---|---|---|---|
| 2030613 | 4/1980 | United Kingdom | 52/165 |

*Primary Examiner*—Robert Canfield
*Attorney, Agent, or Firm*—Daniel Vera

[57] ABSTRACT

The invention constitutes an apparatus and method for inexpensively, repairing wooden fences which fence posts have rotted or failed. The apparatus comprises segment of 90 degree angle iron or angle aluminum or similarly tough angle hardware, which is generally comprised of two flanges joined along a common edge. The flanges have a plurality of holes drilled or punched in the flanges for bolting the flange to a wooden fence post. The lower end of the angle hardware is pointed or sharpened or both pointed and sharpened to facilitate the angle hardware being driven into the ground or partially cleaned out fence post cavity in a concrete fence post base. The hardware may be used to support a new fence post by either setting the hardware piece in the ground by driving or hammering it in to the ground or it may be set in cement and then have a fence post attached to it. The method of use involves determining whether a wooden fence post has rotted completely through and if not severing the remaining connecting fibers of wood at the top of the concrete base. The fence is then shifted slightly, about 1 foot, perpendicular to the fence line. The rotted or remaining post is removed from the concrete base creating typically a 3½ inch by 3½ inch square by 12 to 36 inch deep cavity in the concrete base. The angle hardware described above is driven into the cavity in the concrete base with the flanges exterior faces flat against two sides of the square cavity and the interior face of the angle hardware facing the fence post to which it will be attached. The bottom of the fence post is shaved on one side or two sides to correspond to the thickness and height of the angle hardware which will contact that side or sides of the fence post. The remaining cavity may then be filled with earth or cement or left empty. The fence is realigned with the fence line. holes are drilled into the fence post and the post is bolted or lag screwed to the angle hardware thus effecting the repair.

8 Claims, 4 Drawing Sheets

WOOD FENCE POST REPAIR DEVICE AND METHOD

BACKGROUND OF THE INVENTION (1) Field of Invention

This invention relates to articles of manufacture and methods for repairing wooden fence posts.

(2) Background Information

U.S. Pat. Nos. 4,296,584 Lempa and 4,646,489

DESCRIPTION OF THE PRIOR ART

Typical wooden fence construction includes setting square wooden posts, typically measuring 3½ by 3½ inches square by eight feet in length; nominally referred to as four by fours, vertically into post holes which are usually about from 12 to 36 inches deep and from about 6 to 24 inches in diameter, which have been dug into the ground at spaced intervals and then pouring wet cement into those holes, thereby surrounding the fence post with a hard heavy concrete base once the cement cures. The fence posts are then connected to each other usually with 1½ inch by 3½ inch wooden boards nominally called "2 by 4 stringers," typically one 6 to 12 inches from the top of the posts and one 6 to 12 inches from the bottom. Wooden fence boards; typically measuring ¾ inch thick by 5½ inches wide by six feet in length are then nailed to the stringers so that they span the distance between the two stringers. The wooden fence boards are typically placed with their length vertical and side by side so that two boards will cover a width of eleven to twelve inches given the 5½ inch width previously mentioned. This pattern is followed along the length of the stringers from one to three inches above the ground thus filling in the intervals between the fence posts. Because of the effect of rain water seeping into the concrete base of the fence posts, the part of the post in the ground and also in the concrete base, below the surface of the surrounding earth often rots resulting in the fence falling down or warping requiring that the post be replaced or repaired. This is difficult because of the brittleness of the now aged fence. Therefor a need arises for a means to repair the fence post with as little disturbance to the fence as possible.

Prior art consists of plastic or metal post bases which have two parts; a lower part which is sunk into the earth or driven through the old post concrete base, and an upper section which is intended to receive or attach to the remaining piece of fence post. This is generally to avoid trying to non destructively disassemble the usually delicate, brittle and aged fence and replace the post and the post hole concrete base and then attempt to reassemble the major parts without damaging the old pieces.

The prior art does not address the problem of the variability of the concrete bases having sometimes a hole completely through the concrete base due to the wooden post having been first placed against the bottom of the hole before cement was poured in around the post and sometimes not having a hole but having a concrete plug instead which interferes with the driving through of the lower part of current repair devices which then entails either cutting the lower part or not utilizing the concrete base. Nor does the prior art take advantage of the typical measurements of the hole. Also the prior art usually involves disassembly or lifting of the old fence post in order to then set it down into the repair piece. Some fences will tolerate side to side movement but not up and down movement.

The advantages of using the original concrete base are that; no new holes have to be dug, reduced expense in purchasing and hauling heavy cement, reduced labor in mixing cement, no need to remove old bases and re-utilization or recycling of the old concrete base.

SUMMARY OF THE INVENTION

The present invention provides a device and method for repairing wooden fence posts that have rotted out of their bases or have otherwise been damaged requiring the replacement or repair of a previously in place wooden fence post. The apparatus may also be used to quickly set a fence in unprepared soil.

Assuming that one or several posts in a fence have rotted to the point where the fence and fence post are leaning but not yet completely fallen. Repair would be effected by severing the bottom of one of the leaning posts with a hand saw, axe or machete, flush with or just slightly above the top of the concrete base to ensure separation of the wooden post from the concrete base. The fence and fence post is then shifted, in tact, slightly to one side, about one foot, to expose the part of the fence post that, though rotted is still lodged in the concrete base. Due to typical construction techniques, the fence will generally be able to be shifted to one side without requiring severance or dissection of the fence line and will stay together. The lodged portion of fence post, usually rotten, is then removed from the concrete base by a combination of drilling, cutting, extracting and digging out the pieces of rotten wood, resulting in a cubic cavity generally 3½ by 3½ inches square and about 12 to 36 inches deep in the concrete base. Hereafter sometimes referred to as, "cavity". A repair piece, comprising a segment of 3½ inch by 3½ inch by ¼ inch thick angle iron or similar angle hardware, which has been modified to be corrosion resistant and to have a pointed and sharpened end and having a plurality of holes for bolting the fence post to it, is now inserted into the cavity in the concrete base. The fence post which has been previously shifted to one side is now trimmed with a saw a corresponding ¼ inch along the side corresponding to the placement of the angle hardware in the particular base of the fence post being repaired. That is, sometimes the angle iron flange will be to the left of the post and sometimes to the right of the post depending on how it is placed in the cavity. This trimming, is necessary due to the fact that while the post is able to shift or move side to side perpendicular to the fence line it will not typically be able to move in a direction parallel to the fenced line due to the limitation of the fence post being nailed to the stringers. When the fence post is now brought back into position above the original location, it will align with the repair piece but due to the presence of the repair piece, the fence post will remain shifted off of its original position ¼ inch to one side. However, having been trimmed ¼ inch along one side, the post, will align with the original lengthwise interval position in the fence line. It is also possible to shave the side of the fence post adjacent to the previously described side which will contact the surface of the angle hardware which faces flat against the surface of the fence post which is parallel to the fence line, however unless a ¼ inch misalignment is intolerable, as may be the case where the fence line coincides with a property line between unreasonable neighbors, it is not always necessary. The wooden fence post is then drilled through where it aligns with pre-drilled holes in the hardware repair piece and it is bolted to the repair piece with lag screws or bolts. The remainder of the cavity can be filled in with cement or not. In like fashion all other weakened or failing posts are repaired eliminating the necessity for removing the old fence post completely and replacing the fence post and re-pouring of cement in the post hole.

Alternative uses for this piece of hardware are: as a permanent fence post stub which is set in concrete or as a quickly erected fence pose anchor which can be driven into the earth where it can support a fence post.

A second embodiment of the device comprises one or two segments of flat bar. A preferably corrosion resistant iron flat bar can be used to take advantage of cleaned out fence post concrete bases. The piece or pieces of flat bar are placed into the square hole of the concrete base perpendicular to the fence line so that the fence post may be shifted back into place between the pieces of flat bar. The flat bar may be slightly bent in order to accommodate the fence post without the need for trimming the post. Once the post is in place over the original hole the flat bars are squeezed together; one on each side of the fence post, and bolted to the fence post. The flat bar may be scored for easy breaking to a length or may be made in an assortment of lengths. The flat bar should be able to sink into the hole of the concrete base so that the bars edges are close to contact with the sides of the hole for a minimum of one to six inches of the top portion of the hole; for a maximum fit, the entire length of the hole. However for ease of installation the flat bar should taper to a point.

Yet a third embodiment, similar to the primary embodiment in that it is most easily made of angle iron, is one where the portion above the lower five inches or so is trimmed so that only one full flange extends upwards and the other flange is either completely cut away or save perhaps a small ½ inch vertical rib of flange adjacent to the common corner of the angle iron. In this embodiment little on no sideways movement of the fence line is necessary because due to the portion of flange material cut away there is nothing to interfere with inserting or pounding the piece directly into the cavity of the concrete base; as would be the case were the flange piece tangent to the side of the fence post to which the stringer is typically attached be in place.

BRIEF DESCRIPTION OF THE DRAWING

The figures referred to below represent several versions of the preferred embodiment.

DETAILED DESCRIPTION

Figure 9:
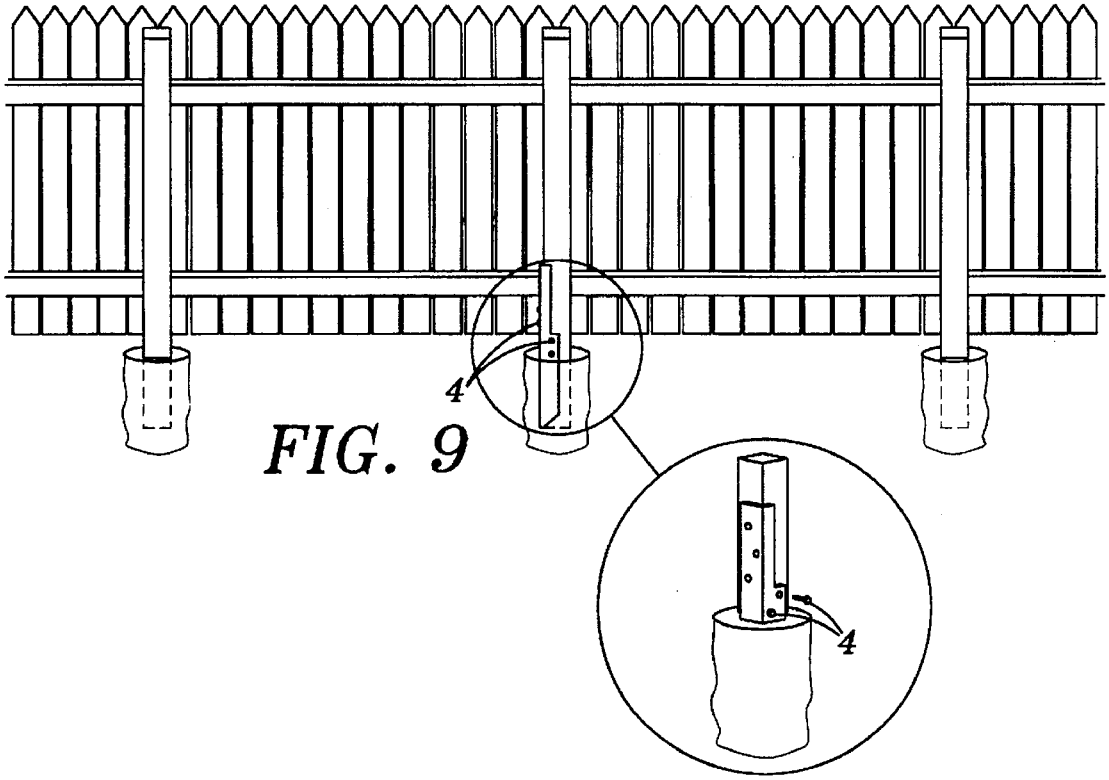
FIG. 9. is a view showing the broken fence post re attached to the concrete base via being bolted to the device.
Figure 10:
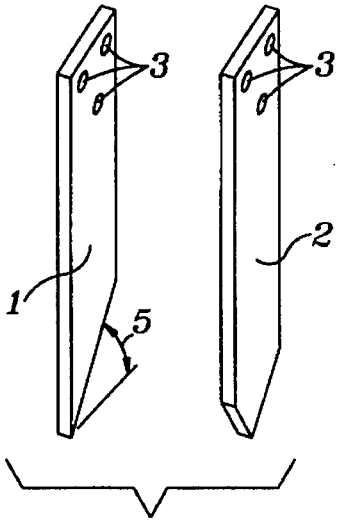
FIG. 10. is an oblique view of a two piece embodiment of the device.
Figure 11:
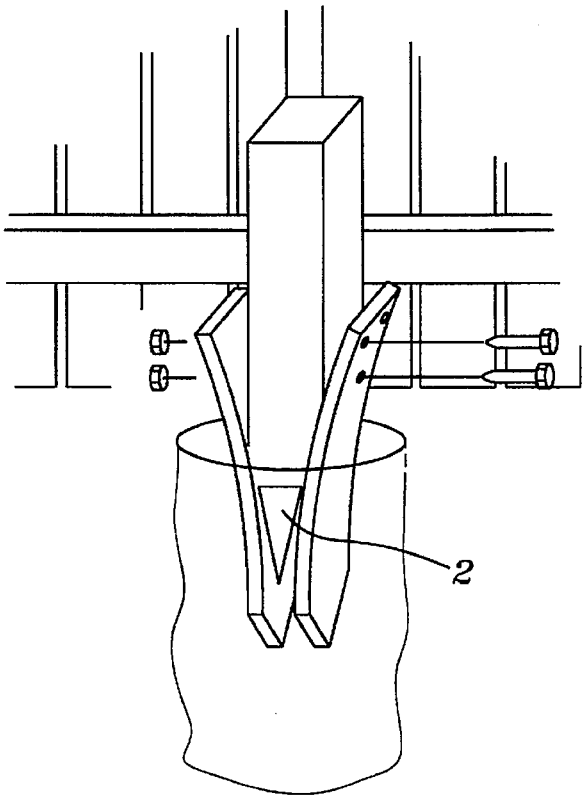
FIG. 11. is an oblique view of the two piece embodiment in place.

Referring to the drawings in detail, there is shown in FIGS. 1 through 14, more than one form of the elements in effecting a wooden fence repair and comprising the components of the apparatus subject of this invention. FIGS. 1, 2, 3, 4, 5, 12, 13 and 14 show parts of a single piece embodiment of the device which makes up a fence post repair kit or fence post base. FIGS. 10 and 11 show a two piece embodiment.

Figure 8:
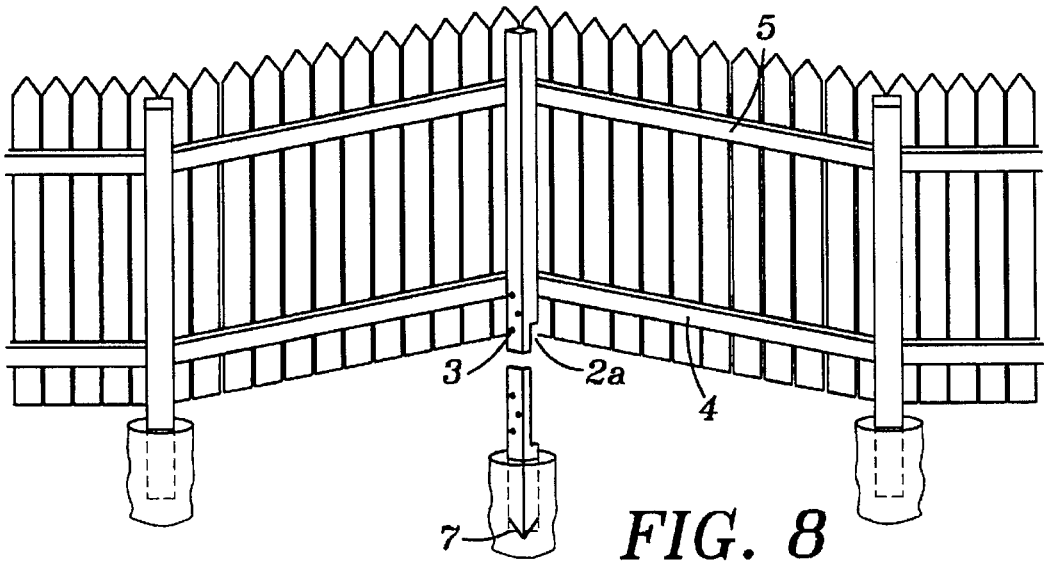
FIG. 8. is a same view as in FIG. 7 showing a notch cut into the fence post bottom and a fence post bracket device placed into the concrete base.

Typically a wooden fence is constructed by; digging a row of holes into the ground, placing 4 by 4 wooden posts into the holes, squaring and leveling the posts along a fence line, and pouring cement into the holes, surrounding the posts. Sometimes the cement is poured in first and the post is sunk into the cement in order to allow for height adjustment. Two rows of boards called stringers are attached to the sides of the posts; one row high on the posts and one row low on the posts, 4 and 5 as shown in FIG. 8, such that a plane is created wherein one surface of the fence posts and one surface of the stringer boards are common to said plane. Sometimes the stringers are nailed to the plane face which is common to the fence posts leaving the sides and one face of the fence posts unobstructed by the stringers. Fence boards are then nailed to the stringers and the fence is made. As a result of moisture concentrating around the concrete base the wooden 4 by 4 posts which are actually 3½" by 3½" occasionally rot and the fence begins to lean to one side or the other of the fence line.

Figure 1:
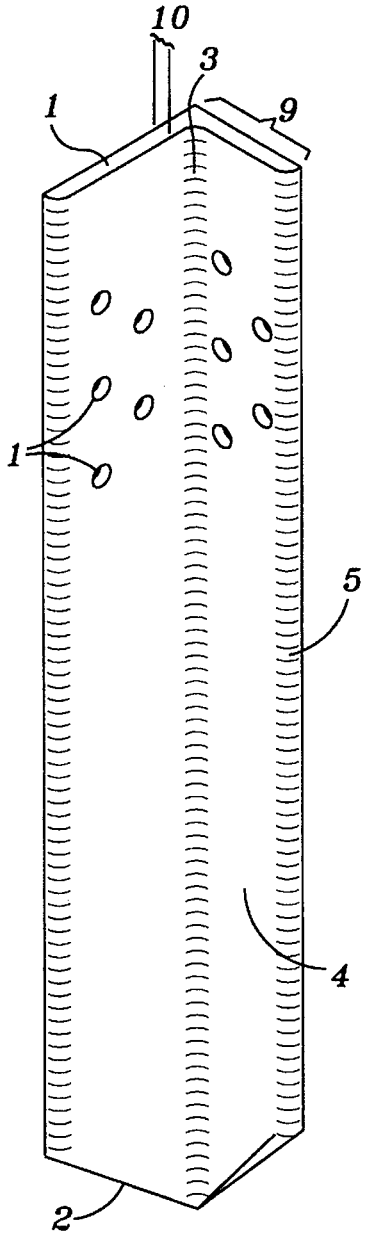
FIG. 1. is an isometric view of the interior side of the device that comprises the primary embodiment of the invention.
Figure 2:
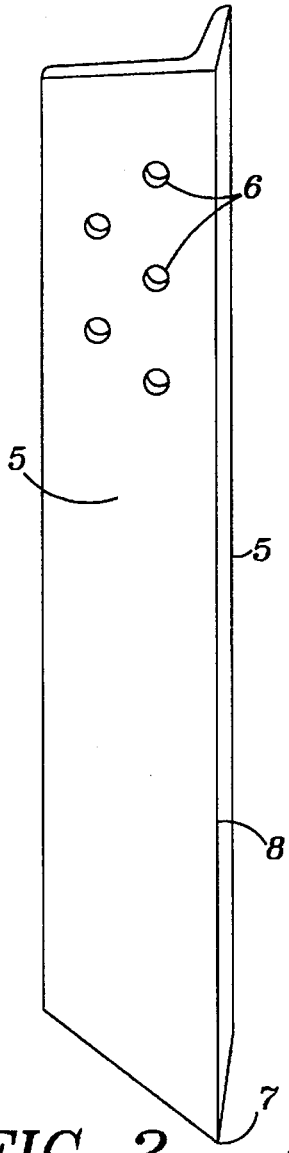
FIG. 2. is also a side pictorial view showing the top and one exterior side of the device.
Figure 7:
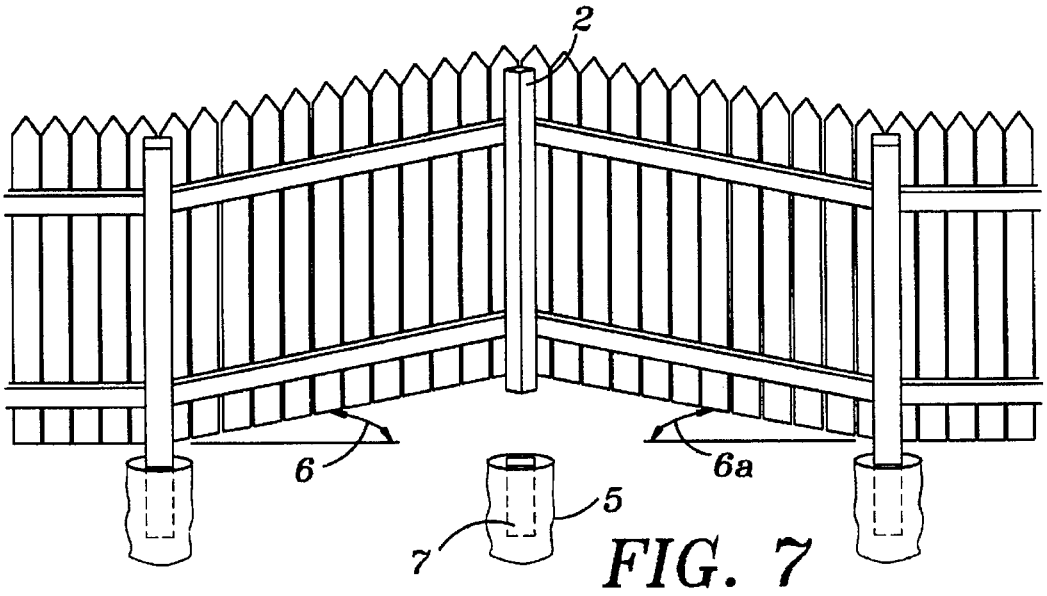
FIG. 7. is the same view as in FIG. 6 showing the fence post having been severed and shifted to one side along with a portion of the fence line.

The primary embodiment, hereafter occasionally referred to as "main piece", shown in FIG. 1 is an approximately 20 to 30 inch long piece of what is commonly known as 3½" by 3½" by ¼" angle iron. This is extruded iron which has two flanges attached to each other at 90 degrees radius is also made of other materials such as aluminum and fiberglass and may be made of bent flat metal plate, The term angle material used herein and in the claims refers to such material. The piece is shown to have a top, 1, which is flat or square, a bottom, 2, an interior common corner, 3, an interior surface, 4, being the surface wherein the flanges face each other at 90 degrees, an exterior surface, 5, and anchor holes, 6, a flange dimension, 9, in this case 3½", and a flange width, 9*a*, in this case ¼". The same piece shown in FIG. 2 also shows the exterior surface 5, the anchor holes 6, a pointed end, 7, and the back edge, 8. This piece, 1 as shown in FIG. 8, may be driven or placed into a previously used fence post concrete base 5 as shown in FIG. 7, which cavity, 7 as shown in FIG. 7, has been cleaned out or partially cleaned out. Once the piece is driven in so that the top of the piece is below the bottom of the lower stringer, 4 as shown in FIG. 8, a fence post may be bolted to the main piece by its anchor holes, 4 as shown in FIG. 9, thus effecting a repair of a fence. The piece may also be directly driven into the earth to provide a more temporary fence post anchor base.

Figure 3:
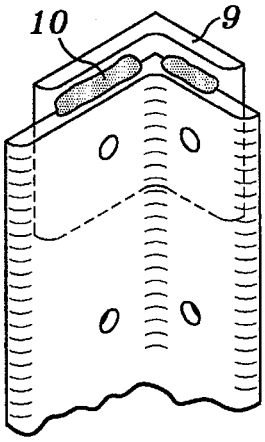
FIG. 3. is an isometric view of the interior side of the device that comprises a secondary embodiment of the invention also showing a hammer plate welded to the top exterior or back side of the device.
Figure 4:
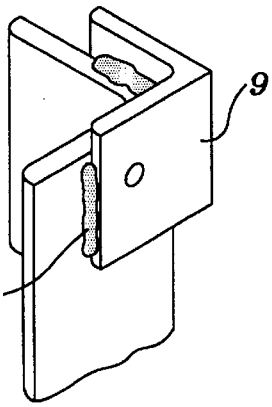
FIG. 4. is an oblique back side view of the device shown in FIG. 3.

Enhancing elements of the primary embodiment are: a hammer plate which is nested and welded to the back side of the main piece 9 as shown in FIGS. 3 and 4. This comprises a short piece of the same angle iron as the main piece is welded or attached so as to slightly protrude above the top of the main piece. By being from the same angle iron manufacturing is simplified. Although a different size and deflection strength iron could be used it is not necessary to do so. The short piece is welded along the sides and top 11 as shown in FIG. 4 and 10 as shown in FIG. 3 respectively. The purpose of allowing the hammer plate to protrude above the main piece is so that a hammer may be used to drive the enhanced main piece into the ground or into a partially obstructed cavity of a concrete base and the top of the hammer plate may mushroom as it is hammered without distorting the main piece. Another function of the hammer piece and a reason not to weld the bottom of it to the main piece is that it may be used as a hang point for a pry bar during the removal of the device.

Figure 5:
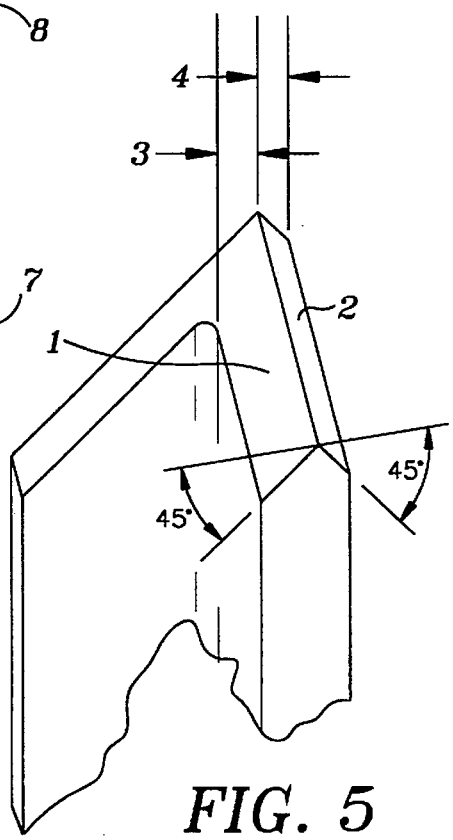
FIG. 5. is an oblique side and edge view of the bottom of the device showing a knife edge on the bottom of the device.

Another enhancement is the beveling of the bottom edge of the main piece. FIG. 5 shows how a bevel may be ground so that the interior bevel 1, has a greater surface, 3, than the exterior bevel, 2 and 4. This allows the piece to bias itself to the sides of the cavity of a used concrete base as it is driven into the base and thus align itself with the walls and one corner of the cavity previously formed when the concrete originally cured around the original wooden post.

A complete bevel towards the exterior side would cause the piece to hang up on any imperfections of the cavity's surface. A complete bevel to the interior side would cause the piece to not end up vertical when bottomed out. It is not always necessary however, to insert the main piece into the concrete base until it hits bottom. It need only be driven in as far as necessary to provide support for the fence taking into consideration its weight and the expected duration of the repair. Also, some concrete bases have no bottom.

Another embodiment shown in FIG. 10, is a two piece device, 1 and 2, for effecting the repair of a fence post utilizing a previously used concrete base. This embodiment comprises two pieces of from about ⅛" to about ¼" by 3½" wide iron hot rolled flat bar or similarly tough durable material such as aluminum or magnesium or and alloy of either or plastic or fiber reinforced plastic. Here the cavity may but need not be well cleaned out before inserting the two pieces of flat bar. Typically the pieces are placed or pounded into the cavity so that their flat sides are perpendicular to the fence line as shown in FIG. 11. A wedge may, but need not, be placed into the cavity to hold the bottoms of the pieces apart, 2 as shown in FIG. 11. The old fence post is brought back into place as the tops of the pieces are held or spread apart. The bottom may be cut square or at an angle, 5, as shown in FIG. 10.

The pieces are brought together and bolted to or through the fence post. Because hot rolled iron flat bar is easy to bend the above instructions can easily be carried out using typical hand tools such as a hammer and a C-clamp.

Figure 12:
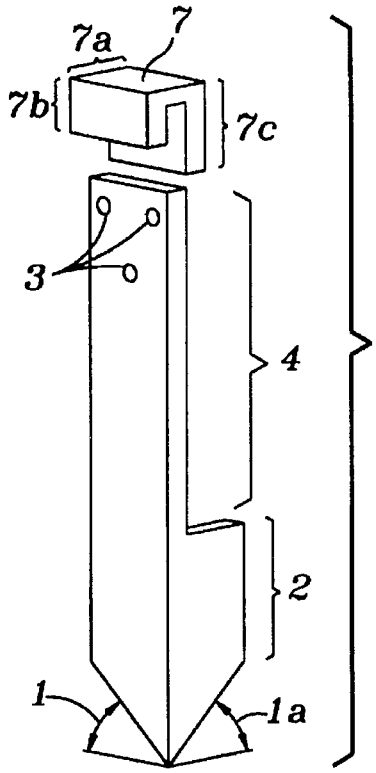
FIG. 12. is an oblique view of an alternate embodiment of the device.
Figure 13:
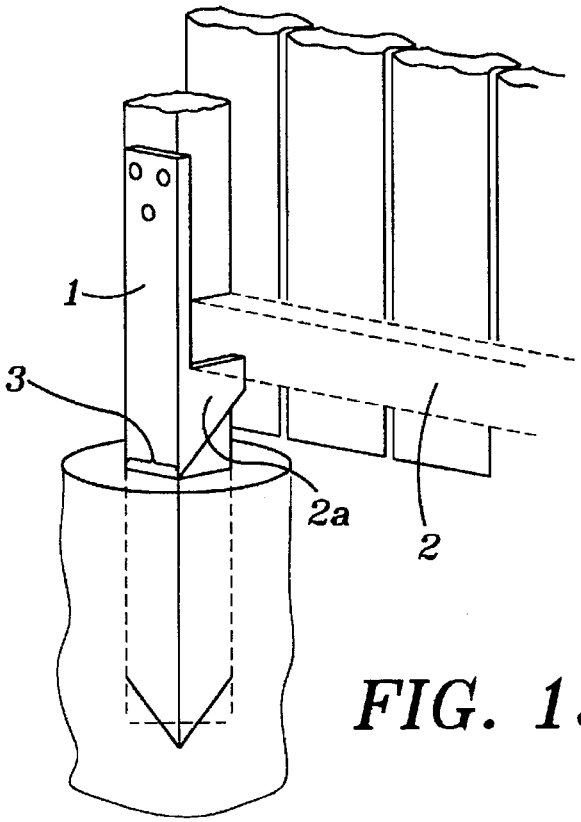
FIG. 13. is an oblique view of the embodiment shown in FIG. 12 as intended to be used in place.
Figure 14:
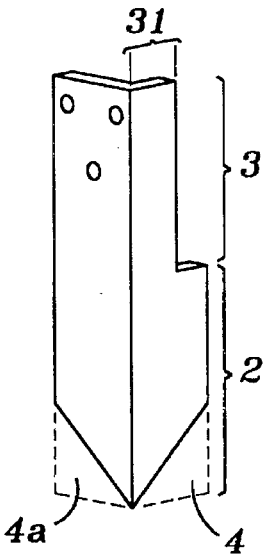
FIG. 14 is an alternate embodiment of the device shown in FIG. 12 showing that part of the flange has been left attached along the upward extending flange of the device.

Yet another embodiment is a one piece device similar to the primary embodiment with the top approximately ½ to ⅞ths of one of the flanges which is to be perpendicular to the fence line is removed, 4 as shown in FIG. 12. This allows the piece to be inserted into the concrete base from about 5 to 12 inches in order to sink the piece so that the flange perpendicular to the fence line, hereafter sometimes referred to as the "perpendicular flange", 2 as shown in FIG. 12, will clear the lower stringer along the fence, 2 and **2*a* as shown in FIG. 13 or clear the bottom of the fence. In such an embodiment much of the strength of the device is lost when the flange perpendicular to the fence line is removed, but installation and repair is greatly facilitated. Because of the weakened side, this piece would probably be best comprised of ⅜" thick iron in order to provide some additional strength to the remaining flange portion of the iron which is bolted to the fence post. A slightly modified version of this embodiment shown in FIG. 14 leaves about a ¾" rib of material, along the common corner of the angle material, 1 as shown in FIG. 14, of the perpendicular flange on the main piece. This will significantly strengthen the remaining flange strengthening the extended flat side against being easily bent, but may require some trimming of the fence post to accommodate the rib when it is snugged up against the piece. If the perpendicular flange is shortened to be about 5 inches long, 2 as shown in FIGS. 12 and 14, and as shown in 1 of FIG. 13, it will typically fit under the stringer, 1 as shown in FIG. 13 and it is unnecessary to shift the fence post laterally in order to insert the piece and attach it to the fence post. The piece is merely inserted or pounded into the cavity of the concrete base and is bolted directly to the fence post as shown in FIG. 13**.

Another way to describe the piece in positive terms is to define it as being comprised of a 5 to 12 inch long piece of 3–12" by 3½" by ¼th to ⅜ths inch thick angle iron having a top and a bottom, wherein one flange extends upwards 5 to 24 inches further than the other flange.

Other variations of the preceding embodiments include that the lower section of the main piece, the bottom, of either the perpendicular or the parallel flange may be cut at an angle in order to lessen the weight of the device or the amount of material used in making the device or in order to minimize the resistance to inserting the device into the cavity yet maximize the strength of the piece in the direction perpendicular to the uncut flange base left intact, **4*a* and/or 4*b* as shown in FIG. 14. All of the embodiments have holes pre drilled into the flanges for allowing bolts or screws to be inserted therethrough for attaching the piece to the fence post, 3 as shown in FIGS. 10, 12 and 14**. Typically the holes are drilled in a pattern wherein the holes do not align in a vertical line so as to reduce the risk of splitting the fence post by causing the wedging of several screws or bolts into the same wood grain line of said post.

All of the embodiments, except for those with welded on hammer pieces, may be driven into the ground with the assistance of a removable hammer piece 7 as shown in FIG. 12, which is typically made of iron or steel and fits loosely to snuggly over the top of the repair piece, that is it has about a ¼ inch to ⅜ inch channel. This hammer piece has two flanges a front flange, **7*b* and a back flange 7*c* as shown in FIG. 12 each about ⅛ to ½ inch thick and are from 1 to 6 inches long and about 3½ inches wide. The hammer piece has a flat top 7*a* as shown in FIG. 12 which is from ¼ th ½ inch thick and about 3½ inches wide and extends from front to back. The flanges are spaced apart so that they form a channel with the top. This piece is used to slip over the top of any of the embodiments to be pounded or hammered into the ground or concrete base cavity to increase the surface target area to be struck by the hammer or whatever is being used to pound the piece. It also disperses the striking energy along the entire width of the piece thereby reducing the mushrooming effect of repeated hammer blows on the top of the piece which if made of aluminum or soft iron may significantly damage the piece making it difficult to align and/or mate it with the fence post being repaired. The hammer piece may have a relatively thin back flange compared to the thickness of the other parts in order to cause as little angling of the main piece when it is placed up against a post; as would be the case in FIG. 13**, to be driven into a concrete cavity.

The Method

This method is described to provide a means for quickly repairing a wooden fence in which intermediate fence posts have rotted at their bottoms.

Figure 6:
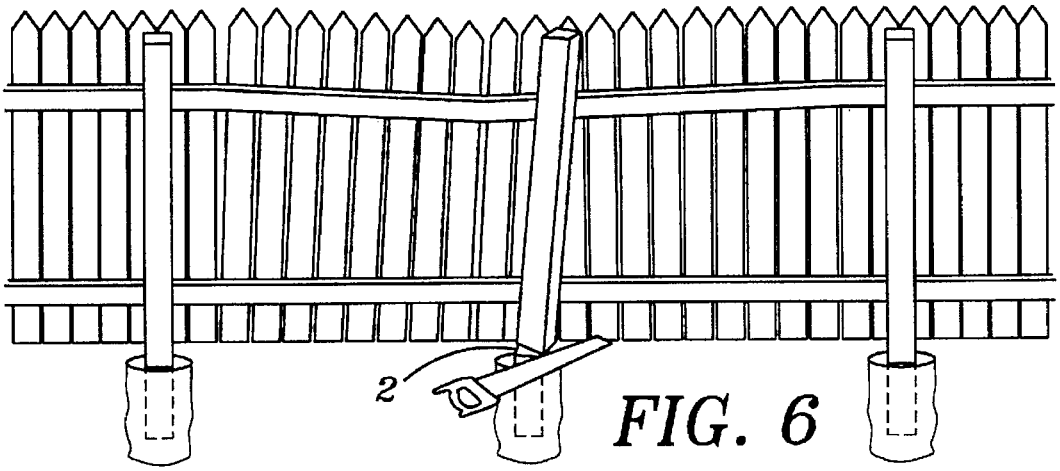
FIG. 6. is an elevational view of a fence line with a broken fence post, also showing how a saw may be placed to completely sever the fence post near its bottom at the top of a typical concrete base.

Repair of a rotten or failed wooden fence post is quickly effected by the following method. First, one completes the severing of the fence post at the top if the concrete base 1 as shown in FIG. 6, by sawing or hacking it free with a saw, axe or machete as necessary. The fence and fence post is then shifted, in tact, slightly to one side, laterally, about one foot, to expose the part of the fence post that, though rotted is still lodged in the concrete base. Due to typical construction techniques, the fence will generally be able to be shifted to one side without requiring severance or dissection of the fence line and will stay together. The lodged portion of fence post, usually rotten, is then removed from the concrete base by a combination of drilling, cutting, extracting and digging out the pieces of rotten wood, resulting in a cubic cavity generally 3½ by 3½ inches square and about 12 to 36 inches deep in the concrete base. Hereafter sometimes referred to as, "cavity". A repair piece, comprising a segment of 3½ inch by 3½ inch by ¼ inch thick angle iron or similar angle hardware, which may have been modified to be corrosion resistant and to have a pointed and sharpened end and having a plurality of holes for bolting the fence post to it, generally as previously described, is now inserted into the cavity in the concrete base. The bottom several inches of the side of the fence post which has been previously shifted to one side is now trimmed with a saw or hammer and chisel a corresponding ¼ inch along the side corresponding to the flange of the angle hardware in the particular base of the fence post being repaired, 2*a* as shown in FIG. 8 which will contact the inside of the flange. This is necessary due to the fact that while the post is able to shift or move laterally or side to side perpendicular to the fence line it will not typically be able to move longitudinally in a direction parallel to the fenced line, due to the limitation of the fence post being nailed to the stringers. When the fence post is now brought back into position above the original location, it will align with the repair piece but due to the presence of the repair piece, the fence post will remain shifted off of its original position ¼ inch to one side and having been trimmed ¼ inch along one side will align with the original lengthwise interval position in the fence line. It is also possible to shave the side of the fence post adjacent to the previously described side which will contact the surface of the angle hardware which faces flat against the surface of the fence post which is parallel to the fence line, however unless a ¼ inch misalignment is intolerable, as may be the case where the fence line coincides with a property line between unreasonable neighbors, it is not always necessary. The wooden fence post is then drilled through where it aligns with the hardware repair piece anchor holes and it is bolted to the repair piece with lag screws or bolts. The remainder of the cavity can be filled in with cement or not. In like fashion all other weakened or failing posts are repaired eliminating the necessity for removing the old fence post completely and replacing the fence post and re-pouring of cement in the post hole.

What is claimed is:

1. A device for repairing wooden fence posts comprising an angle member measuring from 10 to 40 inches in overall length and having two flanges measuring 3 and ½ inches in width and from ⅛th to ⅜th inch in thickness and first and second ends which are top and bottom ends respectively wherein said device further comprises a midway point between said top and bottom ends and a common corner wherein both of said angle member flanges are intact for the bottom 5 to 18 inches of its overall length and one of said flanges extends further than the other thereby comprising a longer flange, so that when viewed obliquely one flange is only ⅛ to ½ as long as the other, thereby comprising a shorter flange; said device's bottom end is pointed and beveled and a plurality of from ¼ to ½ inch diameter to holes are drilled or punched through the longer flange between said midway point and said top end of said device and said top end of said angle member is not sharpened or beveled but is flat.

2. The wooden fence post repair device as in claim 1 wherein said angle member device may be made of any one of the following materials: aluminum, magnesium, iron plastic or fiber reinforced plastic.

3. The device of claim 2, wherein from ¼ to 1 inch of flange material of the shorter flange extends towards the top to act as a stiffening rib along the common corner and length of said longer flange.

4. The device of claim 1, wherein from ¼ to 1 inch of flange material of the shorter flange extends towards the top to act as a stiffening rib along the common corner and length of said longer flange.

5. A wooden fence post repair kit comprising a device of any of claims 2, 3, 4, wherein said kit further comprises a removable hammer piece wherein said hammer piece further comprises a flat top, a front flange and a back flange, wherein further said front flange and said back flange are of unequal length and thickness but generally are from ⅛ inch to ½ inch thick and from 1 to 6 inches long and each are about 3½ inches wide; wherein further said flat top has a front edge and a back edge each in a plane perpendicular to said top and parallel to each other, and a top side and a bottom side, which front and back edges each extend from said top side to said bottom side; said back flange depends downward from said bottom side of said flat top adjacent and tangent to said back edge plane; said front flange depends from said bottom side of said flat top adjacent and tangent to said front edge plane such that a channel is created being bounded by sad flanges and said flat top which channel further comprises a hollow channel that is about 3½ inches long, from 1 to 6 inches deep and from about ¼ inch to about ½ inch wide corresponding to the thickness of the material at the top of said device so as to fit loosely yet snuggly on top of said device.

6. The device of claim 1 wherein said angle member is treated to be corrosion resistant.

7. A method of repairing wooden fence posts which have failed at or rotted at the base which comprises a cement filled post hole into which a wooden square fence post was set prior to the cement curing comprising the steps of:

(a) ensuring that the fence post is severed at or within 6 inches of the top of the base;

(b) shifting the fence with any remaining posts intact sideways approximately one foot perpendicular to the fence line;

(c) removing the fence post segment that is in the concrete base and creating a cavity therein by a combination of drilling, cutting, extracting and digging out the pieces of rotten wood;

(d) inserting by placing or hammering or both a repair device as described in claim 1, into said cavity so that the fence post may nearly mate to the device;

(e) trimming the side of the fence post as needed to allow the post to mate with the device;

(f) affixing the post to the piece by drilling and screwing or bolting it to the device.

8. The method of claim 7 comprising the additional step of filling the concrete base with cement after the repair piece has been inserted into the base cavity.

* * * * *